US008167131B1

(12) United States Patent
Anderson

(10) Patent No.: US 8,167,131 B1
(45) Date of Patent: May 1, 2012

(54) CARRYING DEVICE FOR ART AND CRAFT SUPPLIES

(76) Inventor: Debra A. Anderson, Kamas, UT (US)

( * ) Notice: Subject to any disclaimer, the term of this patent is extended or adjusted under 35 U.S.C. 154(b) by 0 days.

(21) Appl. No.: 12/797,855

(22) Filed: Jun. 10, 2010

(51) Int. Cl.
*B65D 71/00* (2006.01)

(52) U.S. Cl. ..... 206/575; 206/579; 190/102

(58) Field of Classification Search ..... 206/575, 206/576, 579, 224, 232, 542, 320, 371, 459.5; 190/110; 220/17.1, 603
See application file for complete search history.

(56) References Cited

U.S. PATENT DOCUMENTS

| | | | | |
|---|---|---|---|---|
| 853,404 | A * | 5/1907 | Gilbert | 190/110 |
| 1,147,077 | A * | 7/1915 | Collier | 312/200 |
| 1,274,003 | A * | 7/1918 | Christie | 190/111 |
| 1,350,237 | A * | 8/1920 | Porter | 434/298 |
| 2,302,560 | A * | 11/1942 | Latona | 40/723 |
| 2,648,366 | A * | 8/1953 | Higbee et al. | 206/570 |
| 2,804,969 | A * | 9/1957 | Barnett | 206/229 |
| 2,916,841 | A * | 12/1959 | Denis | 40/716 |
| 4,061,224 | A | 12/1977 | Fuhri | |
| D252,535 | S | 7/1979 | MacEvoy | |
| 4,164,085 | A * | 8/1979 | Steeb et al. | 40/726 |
| 4,255,872 | A * | 3/1981 | Williams, Sr. | 434/308 |
| 4,335,812 | A | 6/1982 | Koves | |
| 4,386,642 | A * | 6/1983 | Durbin | 190/110 |
| D300,987 | S * | 5/1989 | Gerch | D3/319 |
| 4,852,293 | A * | 8/1989 | Levine et al. | 43/54.1 |
| 4,852,725 | A | 8/1989 | Folsom | |
| 5,016,752 | A * | 5/1991 | Haugen, Jr. | 206/455 |
| 5,595,302 | A * | 1/1997 | Maydwell et al. | 206/541 |
| 5,642,809 | A * | 7/1997 | Mayville | 206/204 |
| 5,676,240 | A | 10/1997 | Cziraky et al. | |
| 5,799,791 | A * | 9/1998 | Harley | 206/478 |
| 5,829,502 | A * | 11/1998 | Distefano et al. | 150/113 |
| 5,954,193 | A | 9/1999 | Bartee | |
| 6,050,200 | A * | 4/2000 | Sullins et al. | 108/43 |
| 6,193,118 | B1 * | 2/2001 | Kearl | 224/153 |
| 6,244,400 | B1 * | 6/2001 | Bowers | 190/110 |
| 6,250,470 | B1 * | 6/2001 | Mackenzie | 206/579 |
| 6,257,621 | B1 | 7/2001 | Smith | |
| 6,371,288 | B1 * | 4/2002 | Licata | 206/214 |
| 6,385,897 | B1 * | 5/2002 | Klabunde | 43/54.1 |
| 6,547,070 | B1 * | 4/2003 | Kolpin | 206/317 |
| 6,854,915 | B1 * | 2/2005 | Ong | 402/3 |
| 6,981,593 | B1 * | 1/2006 | Klodt | 206/541 |
| 6,986,308 | B1 * | 1/2006 | King et al. | 108/43 |
| D524,049 | S * | 7/2006 | Hughes | D3/289 |
| 7,165,673 | B2 * | 1/2007 | Marks | 206/373 |
| 7,191,925 | B2 * | 3/2007 | Aris et al. | 224/581 |

(Continued)

FOREIGN PATENT DOCUMENTS

FR 2653312 A3 * 4/1991

*Primary Examiner* — David Fidei

(57) ABSTRACT

A carrying device for storing and organizing art and craft supplies featuring a base tray having an enclosure, a cushion component disposed on the bottom of the base tray; a plurality of removable storage boxes or pouches; a base lid pivotally attached to the base tray; a picture holding component disposed in the top of the base lid for holding a photograph; a plurality of first fasteners and second fasteners disposed on an inner surface of the base lid, the first fasteners function to hold the removable storage boxes or pouches and the second fasteners function to hold items such as pens, markers, and the like; and a generally flat inner lid pivotally attached to the base tray positioned between the enclosure of the base tray and the base lid, the inner lid provides a flat working surface.

12 Claims, 4 Drawing Sheets

U.S. PATENT DOCUMENTS

| | | | | |
|---|---|---|---|---|
| 7,287,647 | B1 * | 10/2007 | Licciardi | 206/579 |
| 7,637,377 | B1 * | 12/2009 | Peckholdt, Jr. | 206/579 |
| 2002/0092792 | A1 * | 7/2002 | Wolf, Jr. | 206/579 |
| 2005/0121121 | A1 * | 6/2005 | Wang | 150/117 |
| 2006/0008320 | A1 | 1/2006 | Spaulding | |
| 2006/0144662 | A1 * | 7/2006 | Hu | 190/110 |
| 2008/0093255 | A1 * | 4/2008 | Greaves et al. | 206/579 |
| 2008/0099290 | A1 * | 5/2008 | Stern | 190/109 |
| 2011/0056413 | A1 * | 3/2011 | Andochick | 108/14 |

* cited by examiner

CARRYING DEVICE FOR ART AND CRAFT SUPPLIES

FIELD OF THE INVENTION

The present invention is directed to devices for organizing and storing art supplies, more particularly to a multi-compartmented device for storing art supplies that also provides a flat working surface.

BACKGROUND OF THE INVENTION

Storing and transporting art and craft supplies can be tedious and cumbersome. Some individuals pack their supplies in bags or small boxes, but storing supplies in this manner may make it difficult to find and access the supplies when needed. The present invention features a carrying device for art and craft supplies, which can be used to store and transport the supplies (e.g. for use at home or when traveling). The carrying device also provides a flat working surface for an individual while providing a comfortable means of resting on a user's lap (e.g., with a beaded bottom surface). The device can fold up and zip shut for easy storage and transport.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
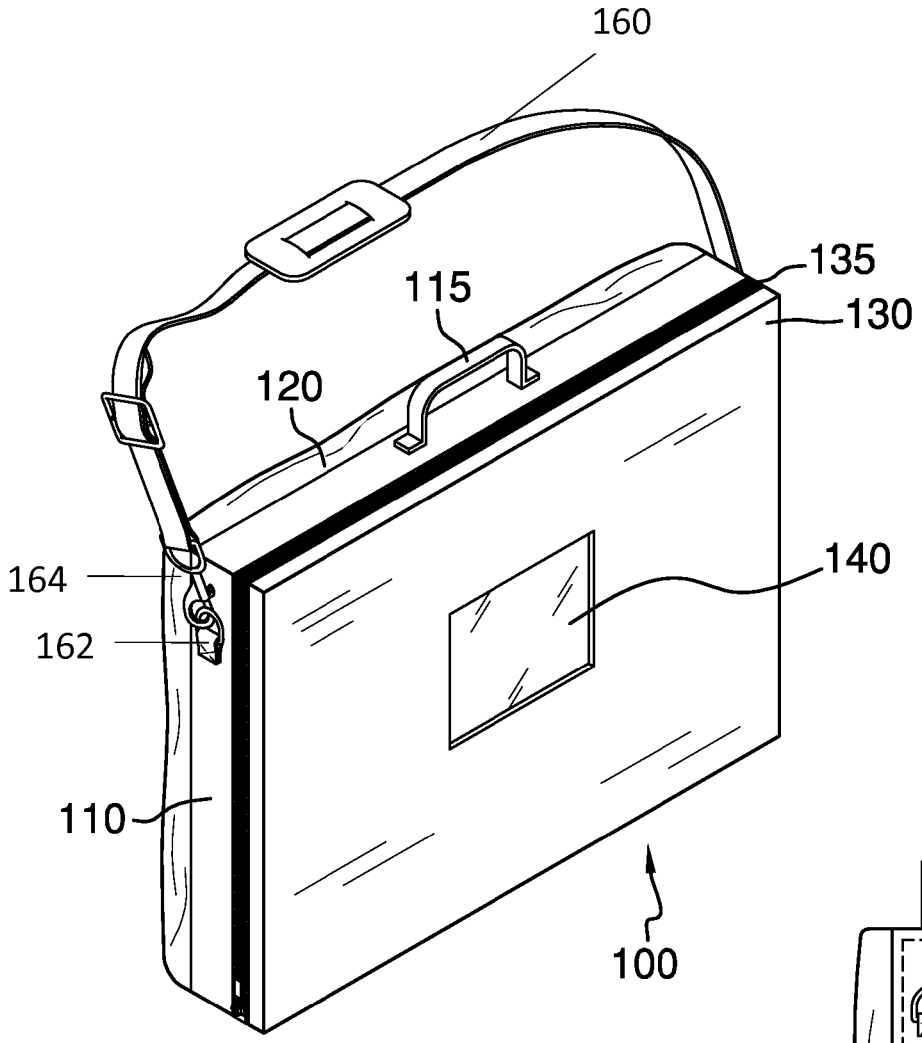
FIG. 1 is a perspective view of the carrying device of the present invention.
Figure 2:
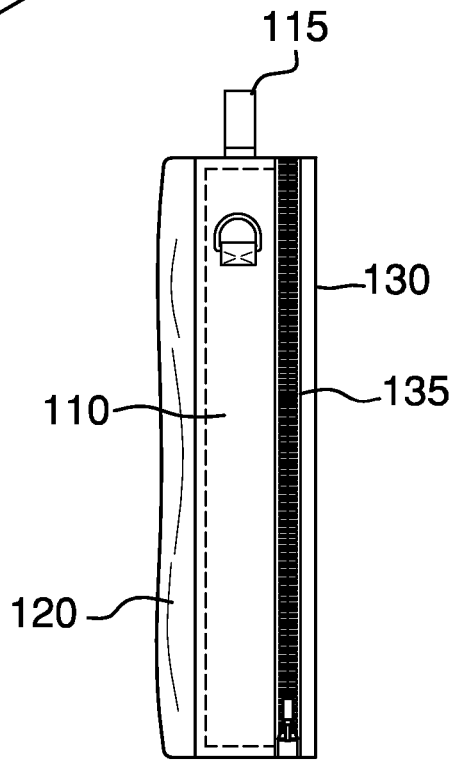
FIG. 2 is a side view of the carrying device of FIG. 1.

Referring now to FIGS. 1-5, the present invention features a carrying device 100 for art and craft supplies, which can be used to store and transport the supplies (e.g. for use at home or when traveling). The carrying device 100 also provides a flat working surface for an individual while providing a comfortable means of resting on a user's lap (e.g., a cushion component 120).

The carrying device 100 of the present invention comprises a base tray 110 having a top surface, a bottom surface, and side walls extending upwardly from the top surface (e.g. forming an enclosure). The base tray 110 has a first side edge, a second side edge opposite the first side edge, a third side edge, and a fourth side edge opposite the third side edge. Disposed on the base tray 110 (e.g., the third side edge, the fourth side edge) is a handle 115 for carrying purposes. Handles are well known to one of ordinary skill in the art.

Disposed on the bottom surface is a cushion component 120. Such cushion components are well known to one of ordinary skill in the art. In some embodiments, the cushion component 120 is constructed from a material comprising microbeads, cotton, foam, or other cushioning material. The cushion component 120 provides comfort to a user when he/she places the device 100 on his/her lap. In some embodiments, the cushion component 120 is removably attached to the bottom surface of the base tray 110. The cushion component 120 also functions to provide a level working surface for the user (e.g., the user can adjust the position of the device 100 via the cushion component 120).

A base lid 130 is pivotally attached to the base tray 110, which can pivot between multiple positions including but not limited to an open position and closed position (e.g., via a pivot mechanism such as a hinge 138) respectively allowing and preventing access to the base tray 110 (e.g., the top surface of the base tray 110, the area enclosed by the side walls, etc.). The base lid 130 may be secured in the closed position via a first securing means 135. In some embodiments, the first securing means 135 is a zipper mechanism, a latch mechanism, a snap mechanism, a tie mechanism, a clamp mechanism, the like, or a combination thereof.

Figure 3:
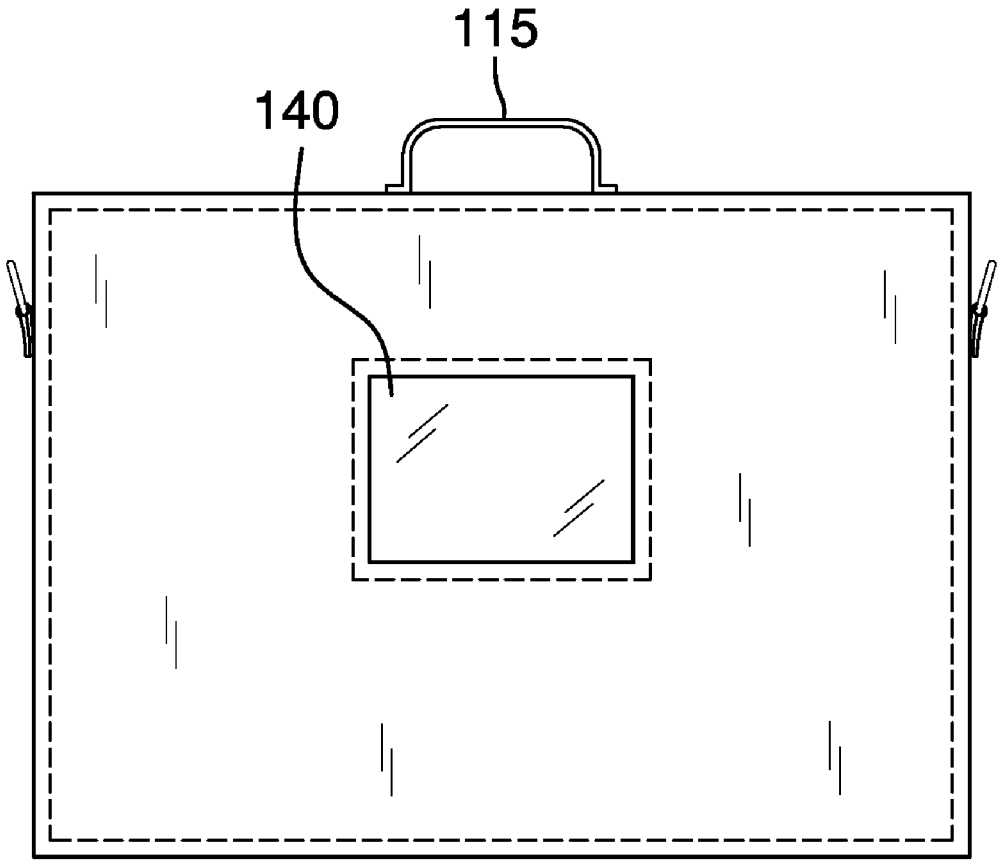
FIG. 3 is a front view of the carrying device of FIG. 1.

The base lid 130 may be generally flat, providing a user a flat working surface. Or, in some embodiments, the base lid 130 may be padded or cushioned or decorated (e.g., with stitching). In some embodiments, a picture holding component 140 is disposed in the base lid 130 (e.g., in the top surface of the base lid 130). The picture holding component 140 allows a user to insert a photo or other picture to personalize the device 100. As shown in FIG. 3, the picture holding component 140 is stitched into the base lid 130, however the present invention is not limited to this configuration.

In some embodiments, the device 100 of the present invention further comprises a shoulder strap 160 which may be adjustable in length (via standard adjustment mechanisms well known to one of ordinary skill in the art). In some embodiments, the shoulder strap 160 is fixedly attached to the base tray 110 (e.g., a side). In some embodiments, the shoulder strap 160 is removably attached to the base tray 110. For example, as shown in FIG. 1, the shoulder strap 160 has a first end and a second end, wherein a first strap attachment means is disposed on each the first end and the second end. The first strap attachment means (e.g., a hook 164) is adapted to engage a second strap attachment means (e.g., a D-ring 166) disposed on the base tray 110. The attachment of the shoulder strap 160 is not limited to the aforementioned attachment means.

Figure 4:
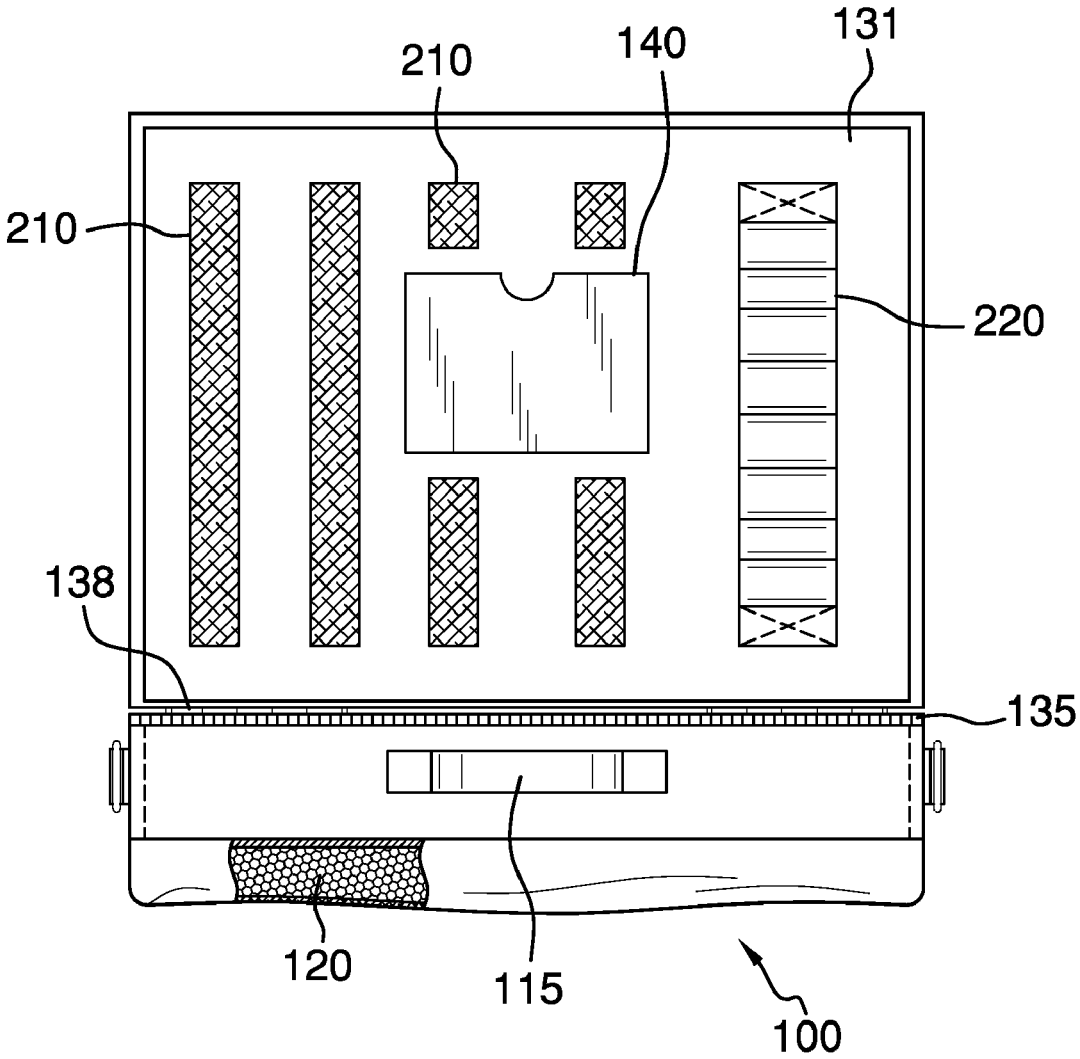
FIG. 4 is a internal view of the carrying device of FIG. 1.

Referring now to FIG. 4, a plurality of first fasteners 210 (e.g., hook-and-loop fasteners) is disposed on the lid 130 (e.g., the inner surface 131 of the base lid 130). The first fasteners 210 may be positioned on a first side of the base lid 130 (e.g., the left side). The first fasteners 210 may be used for a variety of purposes, for example for holding removable storage boxes 310 (of various sizes) and/or pouches 312 with closing flaps 314 (e.g., nylon pouches) (see FIG. 5). The first fasteners 210 may also be positioned in the center area of the lid 130. A plurality of second fasteners 220 (e.g., elastic loops, large or small) for holding pens, markers, glue sticks, crayons, pencils, chalk, scissors, or the like is disposed on the side (e.g. the inner surface 131 of the base lid 130). The second fasteners 220 may be positioned on a second side of the base lid 130 (e.g., the right side). In some embodiments, the picture holding component 140 is accessible via the inner surface 131 of the base lid 130 (see FIG. 4).

Figure 5:
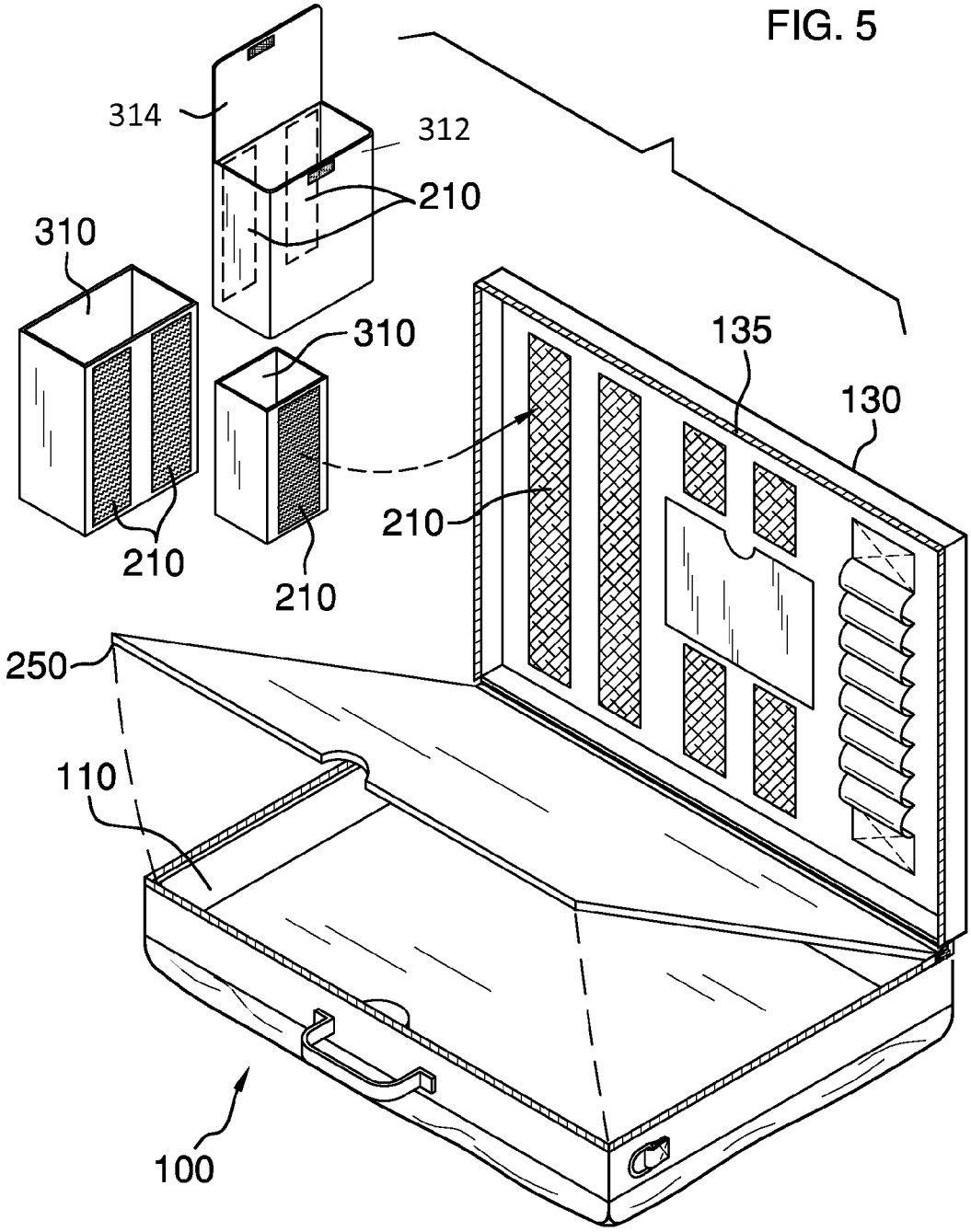
FIG. 5 is an exploded view of the carrying device of FIG. 1.

Referring now to FIG. 5, an inner lid 250 is pivotally attached to the base tray 110 (e.g., via the aforementioned pivot component, e.g., the hinge 138 or an alternate pivot component). The inner lid 250 is positioned between the enclosure of the base tray 110 and the base lid 130. The inner lid 250 can pivot between multiple positions including an open position and closed position respectively allowing and preventing access to the base tray 110 (e.g., the top surface of the base tray 110, the area enclosed by the side walls, etc.). The inner lid 250 can be secured in the closed position via a second securing means. In some embodiments, the second securing means is a snap mechanism, a zipper mechanism, a latch mechanism, a tie mechanism, a clamp mechanism, the like, or a combination thereof.

The inner lid 250 is generally flat, providing a user a flat working surface. In some embodiments, various markings are disposed on the inner lid 250 (e.g., straight edges, ruler markings). Various items can be stored in the base tray 110 (e.g., between the base tray 110 and the inner lid 250). For example, the base tray 110 can store one or more removable storage boxes 310 or pouches 312 (with closing flaps 314), paper, craft items, a paper cutter, a laptop computer, the like, or a combination thereof. The present invention is not limited to the aforementioned items.

The device 100 of the present invention may be constructed in a variety of sizes. For example, in some embodiments, the base tray 110 is between about 15 to 20 inches in length (e.g., about 17 inches), for example as measured from the first side edge to the second side edge. In some embodiments, the base tray 110 is between about 8 to 15 inches in width (e.g., 13 inches) as measured from the third side edge to the fourth side edge. The present invention is not limited to the aforementioned dimensions.

As used herein, the term "about" refers to plus or minus 10% of the referenced number. For example, an embodiment wherein the base tray 110 is about 20 inches in length includes a base tray 110 that is between 18 and 22 inches in length.

The disclosures of the following U.S. patents are incorporated in their entirety by reference herein: U.S. Pat. No. 4,852,725; U.S. Pat. Application No. 2006/0008320; U.S. Pat. No. 5,676,240; U.S. Pat. No. 6,257,621; U.S. Pat. No. 5,954,193; U.S. Pat. No. 4,335,812; U.S. Pat. No. 4,061,224; U.S. Des. 252,535.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A carrying device for storing and organizing art and craft supplies, said carrying device comprising:

(a) a base tray having a top surface, a bottom surface, and side walls extending upwardly from the top surface forming an enclosure wherein a shoulder strap is attached to the base tray;

(b) a cushion component disposed on the bottom surface of the base tray;

(c) a plurality of removable storage boxes or pouches;

(d) a base lid pivotally attached to the base tray, the base lid can pivot between multiple positions including an open position and a closed position respectively allowing and preventing access to the enclosure of the base tray, the base lid is securable in the closed position via a first securing means;

(e) a picture holding component disposed in a top surface of the base lid functioning to hold a photograph of a user's choice;

(f) a plurality of first fasteners disposed on an inner surface of the base lid, the first fasteners function to hold the removable storage boxes or pouches;

(g) a plurality of second fasteners disposed on the inner surface of the base lid, the second fasteners function to hold pens, markers, glue sticks, crayons, pencils, chalk, or scissors; and (h) a generally flat inner lid pivotally attached to the base tray positioned in between the enclosure of the base tray and the base lid, the inner lid can pivot between multiple positions including an open position and a closed position respectively allowing and preventing access to the enclosure of the base tray, the inner lid is securable in the closed position via a second securing means, the inner lid provides a flat working surface.

2. The carrying device of claim 1 further comprising a handle disposed on the base tray for carrying purposes.

3. The carrying device of claim 1, wherein the shoulder strap is adjustable in length.

4. The carrying device of claim 1, wherein a first strap attachment means is disposed on each end of the shoulder strap, the first strap attachment means function to engage second strap attachment means disposed on the base tray.

5. The carrying device of claim 1, wherein the cushion component is constructed from a material comprising microbeads, cotton, or foam.

6. The carrying device of claim 1, wherein the cushion component is removably attached to the bottom surface of the base tray.

7. The carrying device of claim 1, wherein the first securing means or the second securing means is a zipper mechanism, a latch mechanism, a snap mechanism, a tie mechanism, a clamp mechanism, or a combination thereof.

8. The carrying device of claim 1, wherein the picture holding component is accessible via the inner surface of the base lid.

9. The carrying device of claim 1, wherein the second fasteners are elastic loops.

10. The carrying device of claim 1, wherein the first fasteners are hook-and-loop fasteners.

11. The carrying device of claim 1, wherein the pouches comprise closing flaps.

12. The carrying device of claim 1, wherein straight edges or ruler markings are disposed on the inner lid.

* * * * *